United States Patent [19]

Mech

[11] Patent Number: 4,955,059

[45] Date of Patent: Sep. 4, 1990

[54] SPEAKER POWER MATCHING METHOD AND APPARATUS

[75] Inventor: Harold W. Mech, Albuquerque, N. Mex.

[73] Assignee: Motorola, Inc., Schaumburg, Ill.

[21] Appl. No.: 330,248

[22] Filed: Mar. 29, 1989

[51] Int. Cl.[5] ..... H04R 3/00

[52] U.S. Cl. ..... 381/116; 381/113

[58] Field of Search ..... 381/111, 113, 116, 190, 381/191, 174

[56] References Cited

U.S. PATENT DOCUMENTS 3,403,234 9/1968 Barnes, Jr. ..... 381/174
3,742,152 6/1973 Lewiner et al. ..... 381/116
4,481,663 11/1984 Spranger ..... 381/116
4,723,289 2/1988 Schreiber et al. ..... 381/99

FOREIGN PATENT DOCUMENTS 3246336 12/1983 Fed. Rep. of Germany ..... 381/99
2145904 4/1985 United Kingdom ..... 381/99

*Primary Examiner*—Forester W. Isen
*Attorney, Agent, or Firm*—Timothy W. Markison; Steven G. Parmelee; Joseph P. Krause

[57] ABSTRACT

A method and apparatus for controlling the sound pressure levels of a substantially capacitive speaker. The controlling element is substantially capacitive and may be either fixed or variable.

8 Claims, 1 Drawing Sheet

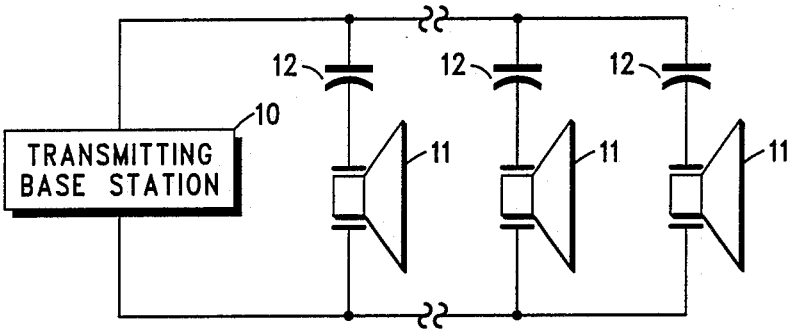
FIG.1
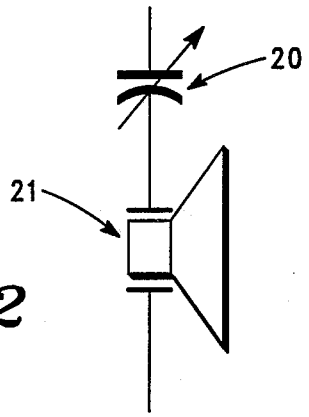
FIG.2
FIG.3
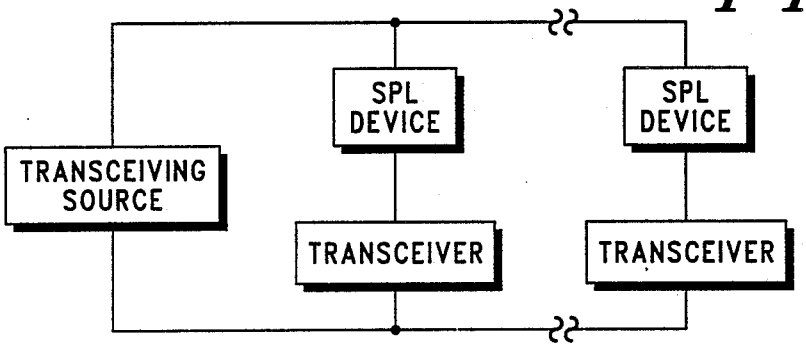

SPEAKER POWER MATCHING METHOD AND APPARATUS

TECHNICAL FIELD

The present invention relates generally to the field of public address systems and more particulary to controlling the sound pressure levels in speakers.

BACKGROUND OF THE ART

In public address systems, or in other multi-source systems, it is common to network speakers together. A typical system supplies a relatively high voltage (many use 70.7 V) which is usually stepped or divided down by a sound pressure level (SPL) device.The SPL device limits the power delivered to the speaker, such that the system can be customized to the environment in which it is incorporated. For example, in inherently noisy areas the speaker's power level can be raised to increase the volume of its output. Similarly, in relatively quite areas the speaker's power level can be lowered to decrease the volume of its output.

An impedance matched transformer is one commonly used SPL device. The transformer consists of a primary winding and a secondary winding with several taps. The primary is connected across the supply lines of the system and the speaker is connected to the secondary. The secondary connections are determined by the power requirements of the speaker. This method is relatively expensive and if the speaker is a piezoelectric speaker, an L-C network is formed which may increase the complexity of the compensation circuit. (A piezoelectric speaker's characteristic impedance is substantially capacitive.)

Another commonly used SPL device is a resistor connected in series with the speaker. This method reduces the cost of the system, however, it increases the overall power requirements and if the speaker is a piezoelectric speaker, an R-C network is formed which may again increase the complexity of the compensation circuit.

Therefore, a need exists for a system that incorporates an SPL device that is relatively inexpensive, reduces the overall power requirements, and does not normally increase the complexity of the compensation circuit.

SUMMARY OF THE INVENTION

This need is substantially met by the speaker power matching method and apparatus disclosed herein. The disclosed invention comprises a substantially capacitive speaker, a capacitor, and a transmitting source. The capacitance value of the capacitor is selected to limit the power received by the speaker such that speaker's output volume is controllably reduced.

In one embodiment, the speaker is a piezoelectric speaker, the transmitting source is a base station, and the capacitor is connected in series with the piezoelectric speaker. The piezoelectric speaker and the capacitor form a capacitive divider and the capacitance of the capacitor is calculated to control the power delivered to the piezoelectric speaker.

In another embodiment, the capacitor is variable. The variable capacitor, when connected in series with the speaker, allows the power delivered to the speaker to be remotely adjusted, thus adding more flexibility to the transmitting system.

BRIEF DESCRIPTION OF THE DRAWINGS

FIG. 1 illustrates a transmitting system incorporating capacitive sound pressure level devices.

FIG. 2 illustrates a speaker device incorporating a variable capacitive sound pressure level device.

FIG. 3 illustrates a transceiver system incorporating capacitive sound pressure level devices.

BEST MODE FOR CARRYING OUT THE INVENTION

FIG. 1 depicts a public address (PA) system, a paging system, or a transmitting system comprising a transmitting base station (10), transmitting transducer or piezoelectric speakers (11) (three shown), and capacitors (12) (three shown) connected in series with the speakers (11). The transmitting base station (10) generates a power signal and delivers it to speaker-capacitor series network. The power signal is divided between the speaker (11) and the capacitor (12), based on the capacitance values of each. The speaker (11) produces an output proportional to the power delivered to it.

For example, given a piezoelectric speaker with a capacitance of approximately 1.5 uF and 10% of the supplied base station voltage to be delivered to it, the capacitor is readily calculated. The capacitance value must equal 0.111 times the capacitance value of the speaker because the circuit is a capacitive divider. Therefore, the capacitor must have a value of 0.111(1.5 uF) or 0.1665 uF. From this example, it can be seen that any percentage of the base station supply voltage can be delivered to the speaker (11), thus any output or sound pressure level of the speaker can be obtained.

Another benefit of the capacitive SPL device is that it adds only a single pole to the overall compensation network. Therefore, the capacitive SPL device normally reduces the complexity of the feedback compensation network.

The performance characteristics of a transceiving system or a receiving system can be directly inferred from the above discussion of the transmitting system, therefore, they will not be discussed.

FIG. 2 illustrates a piezoelectric speaker (11) in series with a variable capacitor (20). The function of this circuit is basically the same as that of the speaker-capacitor series network shown in FIG. 1, except, this configuration allows the sound pressure level of the speaker (11) to be remotely adjusted. Depending on the value of the variable capacitor (20), the sound pressure level could be adjusted from almost 0% to almost 100% of the available power.

What is claimed is:

1. A transmitting system comprising:

at least one transmitting source means for generating signals to produce generated signals:

a plurality of transmitting transducer means having substantially capacitance impedance characteristics for transmitting at least a portion of the generated signals; and a plurality of capacitance means each having substantially single pole impedance characteristics, for dividing the generated signals between the capacitance means and the transmitting transducer means, wherein each of the plurality of capacitance means is electrically coupled in series to one of the plurality of transmitting transducer means to produce a plurality of series coupled transmitting transducer means and capacitance means and wherein the plurality of series coupled transmitting transducer means and capacitance means are electrically coupled in parallel to the at least one signal source, such that sound pressure levels of the transmitting transducer are limited.

2. The transmitting system of claim 1 wherein the transmitting transducer means is comprised of a piezoelectric material.

3. The transmitting system of claim 1, or of claim 2, wherein the capacitance means comprise a variable capacitor for controlling sound pressure levels of the transmitting transducer means.

4. A speaker network comprising:

a subtantially capacitive speaker: and a variable capacitor having substantially single pole impedance characteristics electrically coupled to the speaker for dividing signals betwen the capacitance means and the speaker such that sound pressure levels of the speaker are limited.

5. A transceiver system comprising:

at least one transceiver source means for transceiving signals to produce transceived signals:

at least one transceiver transducer means having substantially capacitance impedance characteristics, electrically coupled to the transceiver means, for transceiving a portion of the transceived signals: and at least one capacitive sound pressure level (SPL) means having substantially single pole impedance characteristics, electrically coupled to the transceiver source means and the transceiving transducer means for dividing the transceived signals between the SPL means and the transceiving transducer means such that pressure levels of the transceiving transducer means are reduced.

6. The transceiving system of claim 5 wherein the SPL means is in series with the transceiver means and has a predetermined capacitance to control the sound pressure level of the transceiver means.

7. The transceiving system of claim 5 wherein the transceiver means is comprised of piezoelectric material.

8. The transceiving system of claim 5 wherein a plurality of series coupled transceiver means and SPL means are electrically coupled in parallel to the transceiving source means.

* * * * *